US007605779B2

(12) United States Patent
Chung et al.

(10) Patent No.: US 7,605,779 B2
(45) Date of Patent: Oct. 20, 2009

(54) PANEL DRIVING METHOD FOR SUSTAIN PERIOD AND DISPLAY PANEL USING THE SAME

(75) Inventors: Woo-Joon Chung, Asan-si (KR); Kyoung-Ho Kang, Suwon-si (KR); Seung-Hun Chae, Suwon-si (KR); Jin-Sung Kim, Cheonan-si (KR)

(73) Assignee: Samsung SDI Co., Ltd., Suwon (KR)

( * ) Notice: Subject to any disclaimer, the term of this patent is extended or adjusted under 35 U.S.C. 154(b) by 863 days.

(21) Appl. No.: 10/958,647

(22) Filed: Oct. 6, 2004

(65) Prior Publication Data

US 2005/0104809 A1 May 19, 2005

(30) Foreign Application Priority Data

Oct. 8, 2003 (KR) ..... 10-2003-0070046

(51) Int. Cl.
*G09G 3/28* (2006.01)

(52) U.S. Cl. ..... 345/60; 315/169.3

(58) Field of Classification Search ... 315/169.1–169.4; 345/60, 63, 66–68; 313/581, 582
See application file for complete search history.

(56) References Cited

U.S. PATENT DOCUMENTS 4,638,218 A * 1/1987 Shinoda et al. ..... 315/169.4
5,541,618 A 7/1996 Shinoda
5,854,540 A * 12/1998 Matsumoto et al. ..... 315/169.1
6,084,558 A * 7/2000 Setoguchi et al. ..... 345/60
6,127,992 A 10/2000 Sano
6,172,465 B1 * 1/2001 Huang ..... 315/169.3
6,188,374 B1 2/2001 Moon (Continued)

FOREIGN PATENT DOCUMENTS

CN 1119336 3/1996

(Continued)

OTHER PUBLICATIONS

Office Action dated Jul. 25, 2006 (for related U.S. Appl. No. 10/861,354).

(Continued)

*Primary Examiner*—Amare Mengistu
*Assistant Examiner*—Yuk Chow
(74) *Attorney, Agent, or Firm*—H.C. Park & Associates, PLC

(57) ABSTRACT

A method for driving a display panel to produce an efficient sustain discharge is provided. In one embodiment, the display panel includes a plurality of scanning electrodes that are driven by a sustain discharge signal. A corresponding plurality of common electrode groups is driven individually by different sustain discharge signals. Sustain discharge is performed by alternately applying high level sustain pulses to each the plurality of scanning electrodes and each the plurality of common electrode groups. Sustain pulses with a high level are applied sequentially to each the plurality of common electrode groups in time intervals between the sustain pulses with the high level applied to the plurality of scanning electrodes. Therefore, it is possible to maintain a duty rate of a sustain discharge signal near 50% while reducing a peak value of currents generated upon sustain discharge driving, thereby achieving stable sustain discharge.

3 Claims, 16 Drawing Sheets

U.S. PATENT DOCUMENTS

| | | | | |
|---|---|---|---|---|
| 6,256,002 | B1 | 7/2001 | Shinoda | |
| 6,278,420 | B1 | 8/2001 | Mikoshiba et al. | |
| 6,288,691 | B1 | 9/2001 | Mikoshiba et al. | |
| 6,288,692 | B1 | 9/2001 | Kanazawa et al. | |
| 6,411,268 | B1 | 6/2002 | Nakamura et al. | |
| 6,448,947 | B1 * | 9/2002 | Nagai | 345/60 |
| 6,531,995 | B2 | 3/2003 | Ishii et al. | |
| 6,747,615 | B2 * | 6/2004 | Jeong | 345/60 |
| 2002/0000955 | A1 | 1/2002 | Derksen et al. | |
| 2004/0217924 | A1 | 11/2004 | Jeong | |

FOREIGN PATENT DOCUMENTS

| | | |
|---|---|---|
| EP | 1043706 | 10/2000 |
| JP | 05-216434 | 8/1993 |
| JP | 09-160525 | 6/1997 |
| JP | 10-333637 | 12/1998 |
| JP | 2000-221939 | 8/2000 |
| JP | 2001-013909 | 1/2001 |
| KR | 1998-086932 | 12/1998 |
| KR | 1999-024358 | 4/1999 |

OTHER PUBLICATIONS

Office Action dated Apr. 23, 2007 (for related U.S. Appl. No. 10/861,354).

Office Action dated Aug. 30, 2007 (for related U.S. Appl. No. 10/861,354).

Office Action dated Dec. 21, 2007 (for related U.S. Appl. No. 10/861,354).

Office Action dated Apr. 16, 2008 (for related U.S. Appl. No. 10/861,354).

* cited by examiner

PANEL DRIVING METHOD FOR SUSTAIN PERIOD AND DISPLAY PANEL USING THE SAME

BACKGROUND OF THE INVENTION

This application claims priority to Korean Patent Application No. 2003-70046, filed on Oct. 8, 2003, in the Korean Intellectual Property Office, the disclosure of which is herein incorporated by reference in its entirety.

1. Field of the Invention

The present invention relates to a method for driving a display panel to display an image by applying a sustain pulse to an electrode structure, such as a PDP (Plasma Display Panel), which forms a plurality of display cells.

2. Description of the Related Art

An electrode driving method of a PDP (Plasma display panel) is disclosed in U.S. Pat. No. 5,541,618. A panel driving timing may be divided into a reset (initialization) period, an address (write) period, and a sustain (display) period. In the reset period, a state of each cell is initialized so that a subsequent addressing operation may be correctly performed. In the address period, cells to be turned-on on the display panel are selected and wall charges are accumulated in the selected cells. In the sustain period, discharge is performed in order to actually display an image on the selected (addressed) cells.

A conventional sustain discharge method is performed by alternately applying a sustain pulse to a scanning electrode and then to a common electrode. However, in the conventional method, since one sustain pulse is applied to a scanning electrode group and another sustain pulse is applied to a common electrode group, a peak value of currents sensed by a driving circuit is great.

SUMMARY OF THE INVENTION

The present invention provides a display panel having an electrode structure that includes a predetermined arrangement of one or more scanning electrode groups and one or more common electrode groups. The invention further provides a method for efficiently driving the display panel.

The present invention discloses a method for driving a display panel to produce an efficient sustain discharge. The display panel may include a plurality of scanning electrodes and a plurality of common electrode groups paired with the plurality of scanning electrodes. The plurality of scanning electrodes may be driven by a sustain discharge signal. The plurality of common electrode groups may be driven individually by different sustain discharge signals. The method for driving the display panel may efficiently produce a sustain discharge by alternately applying high level sustain pulses to each of the plurality of scanning electrodes and each of the plurality of common electrode groups. Additionally, the method may sequentially apply high level sustain pulses to each of the plurality of common electrode groups in time intervals between the high level sustain pulses applied to the plurality of scanning electrodes.

In such a method, a period for sustain discharge may include changing a level of a first common electrode group to a high level when the plurality of scanning electrodes are in a high level; changing levels of the plurality of scanning electrodes to a low level when the first common electrode group is in the high level; changing levels of second through final common electrode groups sequentially to a high level when the plurality of scanning electrodes are in the low level; and changing levels of the plurality of scanning electrodes to a high level when the final common electrode group is in the high level.

According to another aspect of the present invention, there is provided a method for driving a display panel to produce an efficient sustain discharge. The panel may include a plurality of scanning electrode groups and a plurality of common electrode groups paired with the plurality of scanning electrode groups. The plurality of scanning electrode groups may be driven individually by different sustain discharge signals. The plurality of common electrode groups may be driven individually by different sustain discharge signals. The method may produce an efficient sustain discharge by alternately applying high level sustain pulses to each of the plurality of scanning electrode groups and each of the plurality of common electrode groups paired with the plurality of scanning electrode groups. The method may further sequentially apply high level ustain pulses to each of the plurality of common electrode groups paired with the plurality of scanning electrode groups in time intervals between the high level sustain pulses applied to each of the plurality of scanning electrode groups.

The method may apply high level sustain pulses in a predetermined time interval to each of the plurality of scanning electrode groups. In each of the plurality of scanning electrode groups, a period for sustain discharge may include changing a level of a first common electrode group belonging to a corresponding scanning electrode group to a high level when a pulse with a high level is applied to each of the plurality of scanning electrode groups; changing levels of the plurality of scanning electrode groups to a low level when the first common electrode group is in the high level; changing levels of second through final common electrode groups sequentially to a high level when the plurality of scanning electrode groups are in the low level; and changing levels of the plurality of scanning electrode groups to a high level when the final common electrode group is in the high level.

Also, a period for sustain discharge may include changing a level of a first common electrode group to a high level when a pulse with a high level is applied to all the plurality of scanning electrode groups; changing levels of first through final scanning electrode groups sequentially to a low level when the first common electrode group is in the high level; changing levels of second through final common electrode groups sequentially to a high level when the final scanning electrode group is in the low level; and changing levels of first through final scanning electrode groups sequentially to a high level when the final common electrode group is in the high level.

According to another aspect of the present invention, there is provided a method for driving a display panel to produce an efficient sustain discharge. The panel may include a plurality of common electrodes and a plurality of scanning electrode groups paired with the plurality of common electrodes, The plurality of common electrodes may be driven by a sustain discharge signal. The plurality of scanning electrode groups may be driven individually by different sustain discharge signals. Sustain discharge may be performed by alternately applying high level sustain pulses to each of the plurality of common electrodes and each of the plurality of scanning electrode groups, and by sequentially applying high level sustain pulses to each of the plurality of scanning electrode groups in time intervals between the high level sustain pulses applied to the plurality of common electrodes.

In one embodiment, a period for sustain discharge may include: changing a level of a first scanning electrode group to a high level when the plurality of common electrodes are in a high level; changing levels of the plurality of common electrodes to a low level when the first scanning electrode group is in the high level; changing levels of second through final scanning electrode groups sequentially to a high level when the plurality of common electrodes are in the low level; and changing levels of the plurality of common electrodes to a high level when the final scanning electrode group is in the high level.

According to another aspect of the present invention, there is provided a method for driving a display panel to produce an efficient sustain discharge. The panel may include a plurality of common electrode groups and a plurality of scanning electrode groups paired with the plurality of common electrode groups. The plurality of common electrode groups may be driven individually by different sustain discharge signals. The plurality of scanning electrode groups may also be driven individually by different sustain discharge signals. The sustain discharge may be performed by alternately applying high level sustain pulses to the plurality of common electrode groups and the plurality of scanning electrode groups paired with the plurality of common electrode groups, and by sequentially applying high level sustain pulses to each of the plurality of scanning electrode groups paired with the plurality of common electrode groups, in time intervals between the high level sustain pulses applied to the plurality of common electrode groups.

In this embodiment, high level pulses may be applied in a predetermined time interval to each of the plurality of common electrode groups. In each of the plurality of common electrode groups, a period for sustain discharge may include: changing a level of a first scanning electrode group belonging to a corresponding common electrode group to a high level, when a pulse with a high level is applied to each of the plurality of common electrode groups; changing levels of the plurality of common electrode groups to a low level when the first scanning electrode group is in the high level; changing levels of second through final scanning electrode groups sequentially to a high level when the plurality of common electrode groups are in the low level; and changing a voltage applied to the plurality of common electrode groups to a high level when the final scanning electrode group is in the high level.

Also, a period for sustain discharge may include changing a level of a first scanning electrode group to a high level when all the plurality of common electrode groups are in a high level; changing levels of first through final common electrode groups sequentially to a low level when the first scanning electrode group is in the high level; changing levels of second through final scanning electrode groups sequentially to a high level when the final common electrode group is in the low level; and changing first through final common electrode groups sequentially to a high level when the final scanning electrode group is in the high level.

Another aspect of the present invention may provide a display panel with an electrode structure that includes a plurality of scanning electrodes driven by a sustain discharge signal; and a plurality of common electrode groups, which are paired with the plurality of scanning electrodes and driven individually by different sustain discharge signals.

Another aspect of the invention may provide a display panel having an electrode structure that includes a plurality of scanning electrode groups, which are driven individually by different sustain discharge signals; and a plurality of common electrode groups, which are paired with the plurality of scanning electrode groups and driven individually by different sustain discharge signals.

Yet another aspect of the invention may provide a display panel having an electrode structure that includes a plurality of common electrodes, which are driven by a sustain discharge signal; and a plurality of scanning electrode groups, which are paired with the plurality of common electrodes and driven individually by different sustain charge signals.

Yet another aspect of the present invention may provide a display panel having an electrode structure that includes a plurality of common electrode groups, which are driven individually by different sustain discharge signals; and a plurality of scanning electrode groups, which are paired with the plurality of common electrode groups and driven individually by different sustain discharge signals.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

Hereinafter, embodiments of the present invention will be described in detail with reference to the appended drawings. The present embodiments will be explained based on a method for driving an AC-type plasma display panel.

Figure 1:
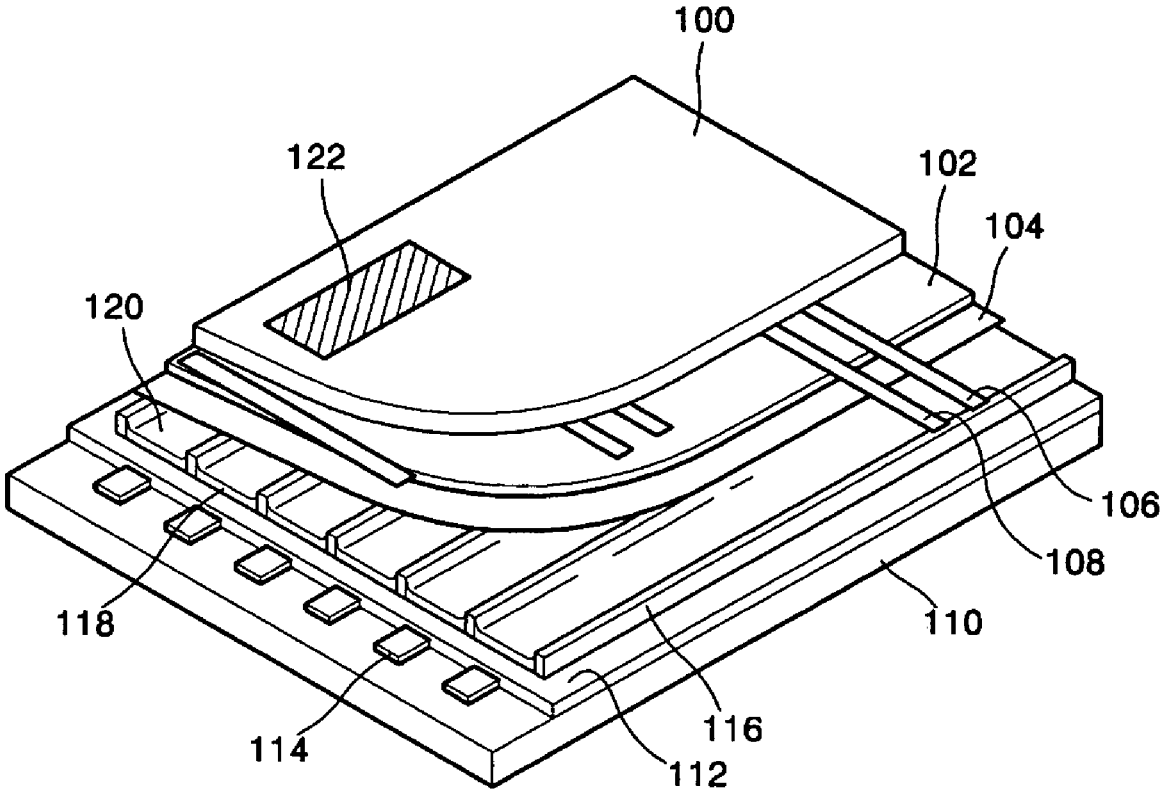
FIG. 1 is a perspective view of an AC-type plasma display panel to which a method of the present invention may be applied.

FIG. 1 is a perspective view of an AC-type plasma display panel to which the present invention may be applied. Pairs of a scanning electrode 106 and a sustain (common) electrode 108, which are covered with a dielectric layer 102 and a protection film 104, are arranged in parallel with each other on a first glass substrate 100. A plurality of address electrodes 114, which may be covered with an insulator layer 112, may be arranged on a second glass substrate 110. The address electrode 114 is arranged in a manner to cross with the scanning electrode 106 and common electrode 108. Partition walls 116 may be formed on the insulator layer 112 covering the address electrodes 114 in a manner to be parallel to the address electrodes 114. Also, phosphors 118 may be formed on the insulator layer 112 and between the partition walls 116. The first glass substrate 100 and the second glass substrate 110 may be opposite to each other, between which a discharge space 120 may be formed by a plurality of the scanning electrodes 106 and common electrodes 108, and the address electrodes 114 and the partition walls 116. A discharge cell 122 may be formed in a region where an address electrode 114 crosses with a pair of a scanning electrode 106 and a common electrode 108.

Figure 2:
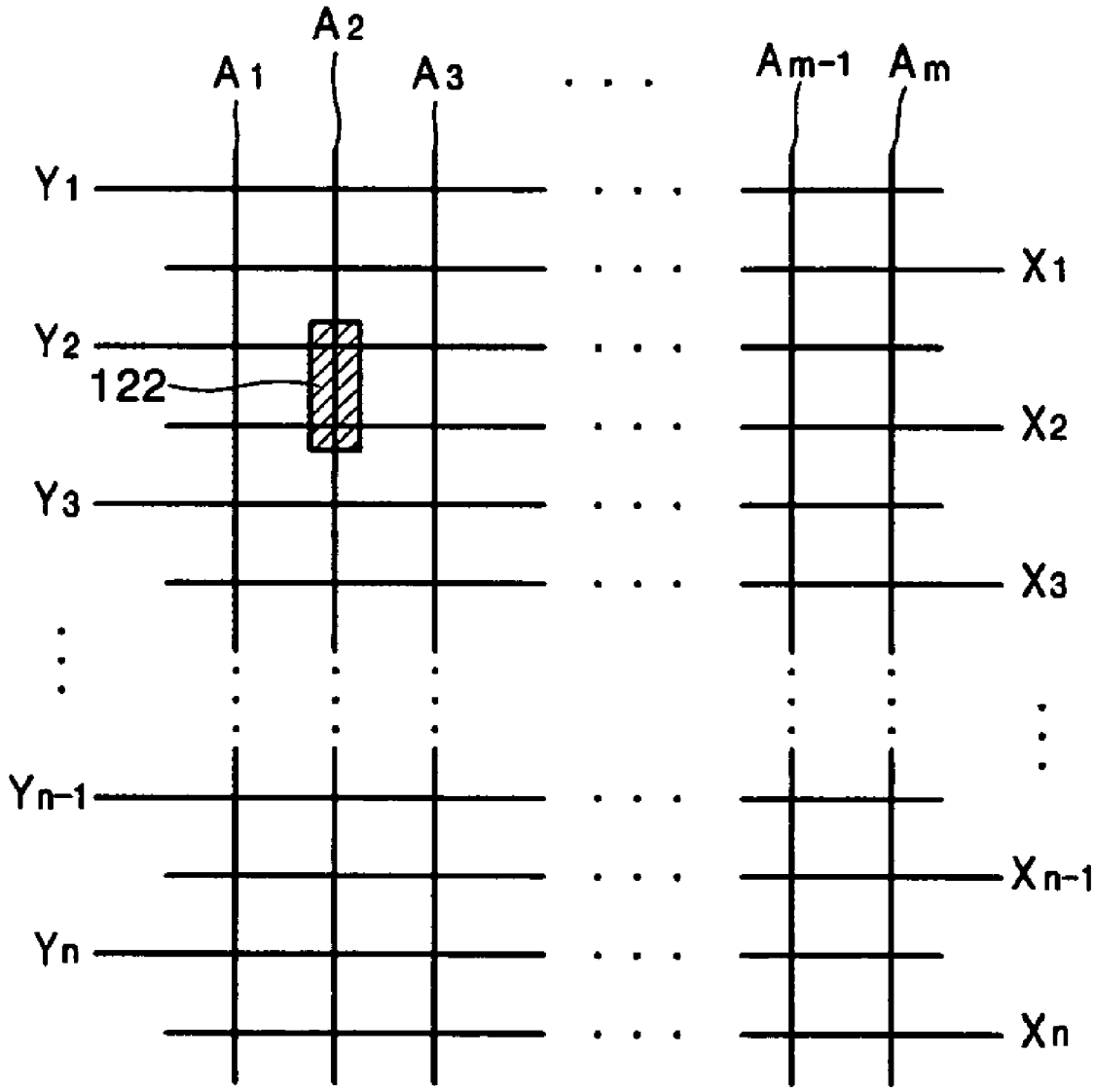
FIG. 2 illustrates an electrode arrangement of a display panel to which the present invention may be applied.

FIG. 2 illustrates an electrode arrangement of a display panel to which the present invention may be applied. Electrodes may be arranged with a matrix structure of m×n. Address electrodes A1 through Am may be arranged in the column direction of the matrix structure, and N scanning electrodes $Y_1$ through $Y_n$ and N common electrodes $X_1$ through $X_n$ may be arranged in the row direction thereof. A discharge cell 122 formed in a region where an address electrode $A_2$ crosses with a pair of a scanning electrode $Y_2$, and a common electrode $X_2$, shown in FIG. 2, corresponds to the discharge cell 122 shown in FIG. 1. A discharge cell to be displayed may be selected by an address electrode and a scanning electrode, and the selected discharge cell may perform a sustain discharge by the scanning electrode and a common electrode.

Figure 3:
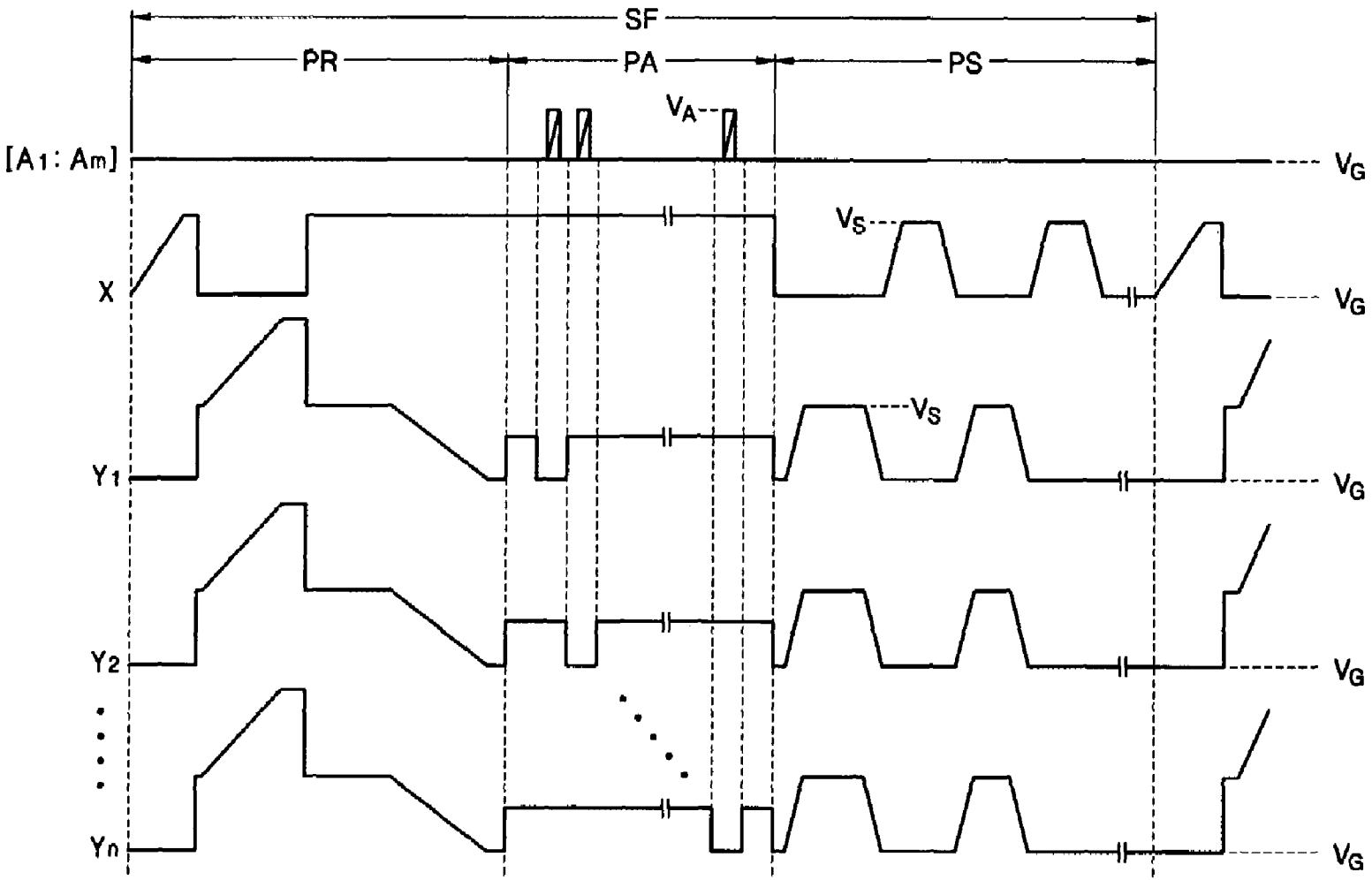
FIG. 3 is a timing diagram for explaining an example of driving signals used in the display panel shown in FIG. 1.

FIG. 3 is a timing diagram for explaining an example of driving signals used in the display panel shown in FIG. 1. FIG. 3 shows driving signals applied to an address electrode A, a common electrode X and scanning electrodes $Y_1$ through $Y_n$ in a sub-field SF according to an Address Display Separated (ADS) driving method used in an AC PDP. Referring to FIG. 3, a sub-field SF may include a reset period PR, an address period PA, and a sustain discharge period PS.

In the reset period PR, a reset pulse may be applied to all groups of scanning electrodes $Y_1$ through $Y_n$, so that states of wall charges of cells are initialized. Since the reset period PR exists prior to the address period PA and cell initialization is performed throughout an entire screen during the reset period PR, wall charges in all display cells may be uniformly distributed after the reset period PR. Just after the reset period PR ends, the address period PA begins. In the address period PA, a bias voltage $V_e$ may be applied to a common electrode X, and a display cell may be selected by simultaneously turning on one of the scanning electrodes $Y_1$ through $Y_n$ and one of the address electrodes $A_1$ through $A_m$ crossing at the location of a cell to be displayed. After the address period PA ends, a sustain pulse $V_s$ may be alternately applied in the sustain discharge period PS to the common electrode X and to the scanning electrodes $Y_1$ through $Y_n$. During the sustain discharge period PS, a voltage $V_G$ with a low level may be applied to the address electrodes $A_1$ through $A_m$.

FIG. 3 illustrates a driving signal in which a group of a reset period PR, an address period PR and a sustain discharge period PS exists in a sub-field SF. However, a single sub-field may be divided into a predetermined number of the groups. For example, it may be possible to divide the scanning electrodes $Y_1$ through $Y_n$ into a predetermined number of groups and to apply a reset period PR, an address period PR, and a sustain discharge period PS to each of the groups. Also, for example, it may be possible to divide a plurality of common electrodes X into a predetermined number of common electrode groups and apply a sustain discharge period PS to each of the common electrode groups.

Hereinafter, for the convenience of descriptions, high level periods of the driving signal will be denoted by $S_Y$, $S_{Y1}$, $S_{Y2}$, $S_X$, $S_{X1}$ and $S_{X2}$, etc. Y represents a scanning electrode; $Y_1$ represents a scanning electrode belonging to a first group; and $Y_2$ represents a scanning electrode belonging to a second group. Similarly, X represents a common electrode; $X_1$ represents a common electrode belonging to a first group; and $X_2$ represents a common electrode belonging to a second group. It goes without saying that a falling transition period, a low level period and a rising transition period exist between the high level periods for each of the electrodes.

Figure 4A:
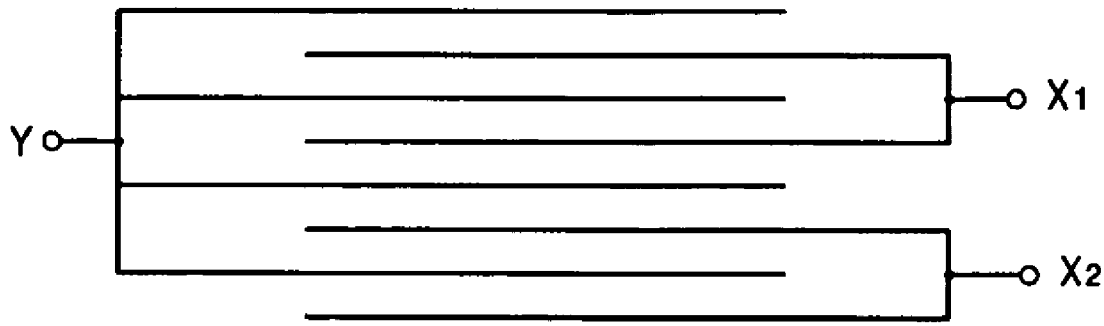
FIG. 4*a* schematically shows an electrode structure for sustain discharge of the display panel, according to an embodiment of the present invention.

FIG. 4*a* schematically shows an embodiment of an electrode structure that permits efficient sustain discharge of the display panel.

Referring to FIG. 4*a*, in a sustain discharge period, a scanning electrode Y may be driven by a timing signal, and common electrodes may be grouped into a first group $X_1$ and a second group $X_2$ so that common electrodes of the first group $X_1$ and common electrodes of the second group $X_2$ may be driven individually by two different timing signals.

Figure 4B:
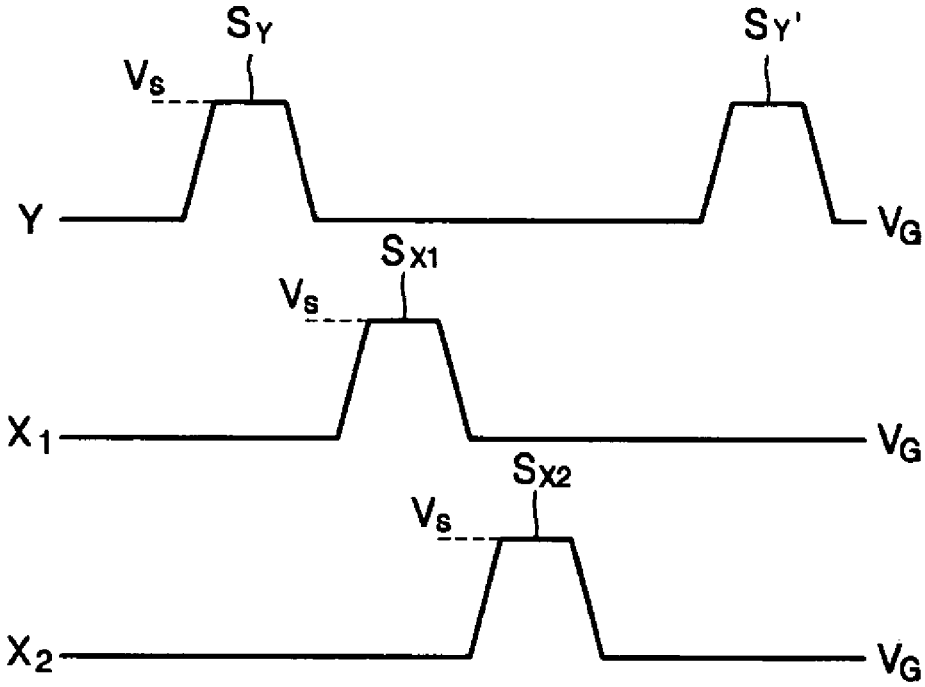
FIGS. 4*b*, 4*c*, and 4*d* are timing diagrams each showing a period of a sustain discharge signal applied to the electrode structure shown in FIG. 4*a*, according to embodiments of the present invention.

FIG. 4*b* is a timing diagram showing a period of a sustain discharge signal applied to the electrode structure shown in FIG. 4*a*, according to an embodiment of the present invention. That is, FIG. 4*b* shows a period of a sustain discharge signal applied alternately to the scanning electrode Y and the common electrodes $X_1$ and $X_2$ in the sustain discharge period. Address electrodes $A_1$ through $A_m$ (not shown) may be maintained in a low level during the sustain discharge period, which will be the same in other embodiments to be described later. Between the high level sustain pulses $S_Y$ and $S_Y'$ applied to the scanning electrode Y, sustain pulses $S_{X1}$ and $S_{X2}$ may be applied sequentially to the common electrode $X_1$ of the first group and the common electrode $X_2$ of the second group, respectively. In other words, the sustain pulses may be applied sequentially in an order of $S_Y$->gap->$S_{X1}$->gap->$S_{X2}$->gap->$S_Y'$.

Figure 4C:
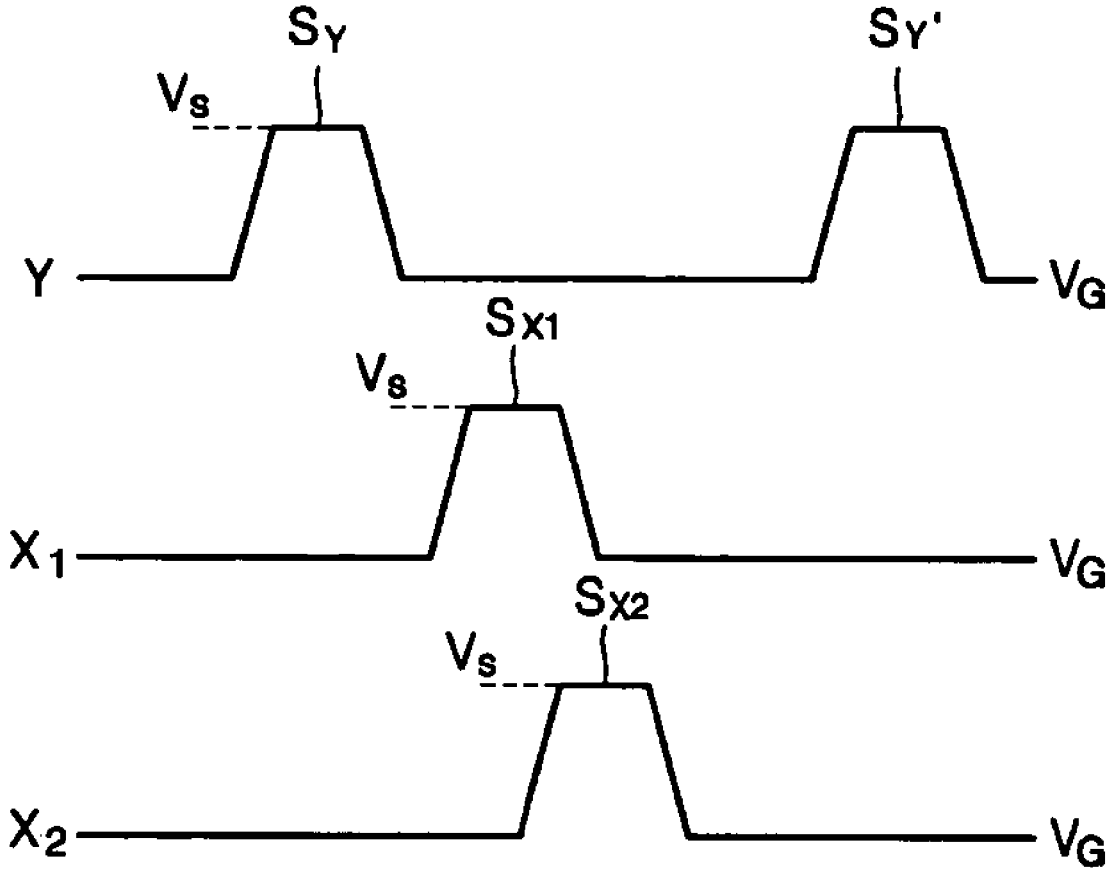

FIG. 4*c* is a timing diagram of a sustain discharge signal applied to the electrode structure shown in FIG. 4*a*, as a modified example of FIG. 4*b*, according to another embodiment of the present invention. Between the high level sustain pulses $S_Y$ and $S_Y'$ applied to the scanning electrode Y, sustain pulses $S_{X1}$ and $S_{X2}$ may be applied sequentially to the common electrode $X_1$ of the first group and the common electrode $X_2$ of the second group, respectively. In other words, the sustain pulses may be applied sequentially in an order of $S_Y$->gap->$S_{X1}$->gap->$S_{X2}$->gap->$S_Y'$.

Figure 4D:
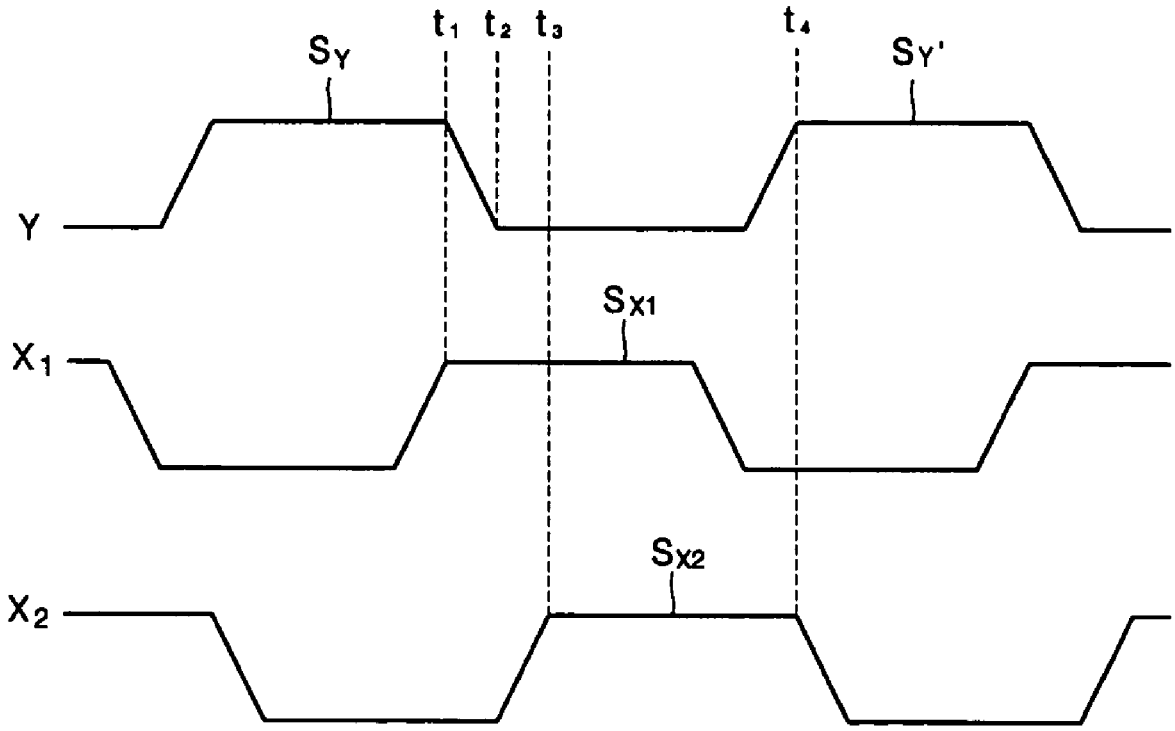

FIG. 4*d* is a timing diagram of a sustain discharge signal applied to the electrode structure shown in FIG. 4*a*, according to another embodiment of the present invention. Between the high level sustain pulses $S_Y$ and $S_Y'$ applied to the scanning electrode Y, sustain pulses $S_{X1}$ and $S_{X2}$ may be applied sequentially to the common electrode $X_1$ of the first group and the common electrode $X_2$ of the second group, respectively. A period for sustain discharge shown in FIG. 4*d* will be described as follows.

When the scanning electrode Y is in a high level, a level of the common electrode $X_1$ of the first group may be changed at a time point $t_1$ to a high level. When the common electrode $X_1$ of the first group is in the high level, the level of the scanning electrode Y may be changed at a time point $t_2$ to a low level. When the scanning electrode Y is in the low level, the levels of common electrodes $X_2$ of second through final groups may be changed sequentially at a time point t3 to a high level. When the common electrode $X_2$ of the final group is in the high level, the level of the scanning electrode Y may be changed at a time point $t_4$ to a high level.

By applying the sustain discharge signals in such a manner, it is possible to maintain a duty rate of the sustain discharge signal near 50% while reducing a peak value of currents, thereby achieving stable sustain discharge.

Figure 5A:
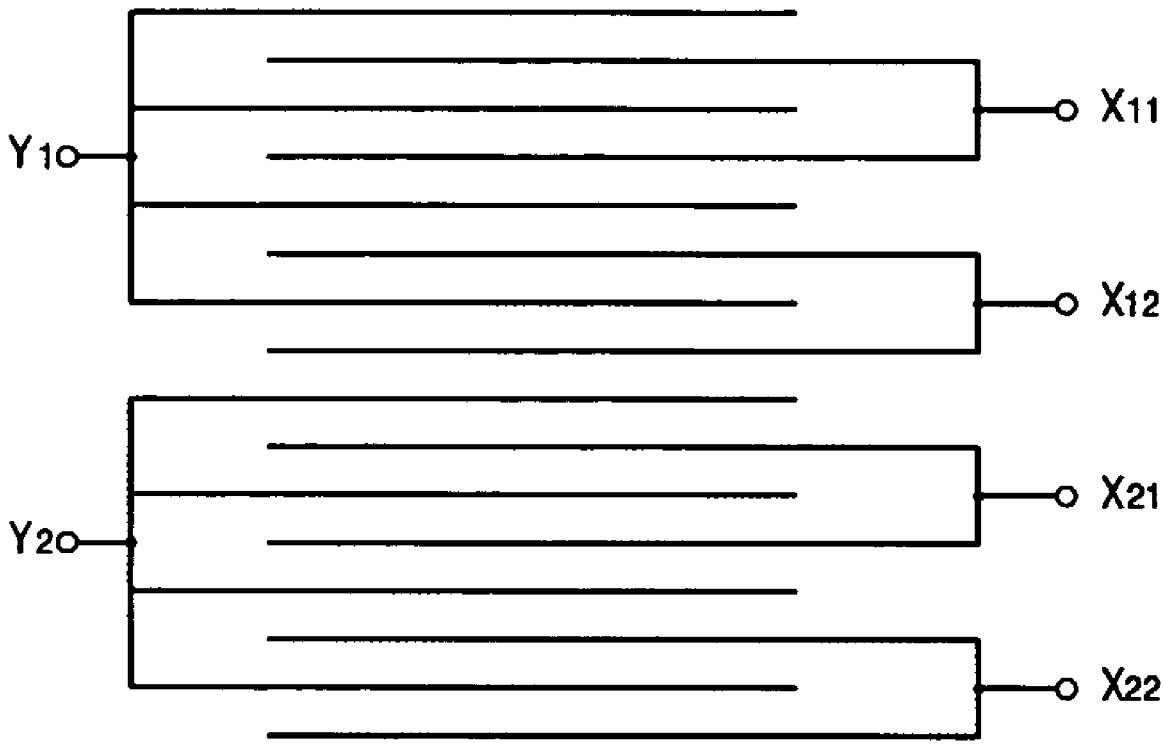
FIG. 5*a* schematically shows an electrode structure for sustain discharge of a display panel, according to another embodiment of the present invention.

FIG. 5*a* schematically shows an electrode structure for sustain discharge of a display panel, as a modified example of the electrode structure shown in FIG. 4*a*, according to another embodiment of the present invention, Referring to FIG. 5*a*, scanning electrodes may be grouped into two groups $Y_1$ and $Y_2$, which may be driven by two different sustain discharge signals. The respective scanning electrode groups $Y_1$ and $Y_2$ for sustain discharge may be sub-grouped in pairs with a plurality of common electrodes ($X_{11}$ and $X_{12}$) and ($X_{21}$ and $X_{22}$), respectively. Each of the groups $Y_1$ and $Y_2$ has the same structure as the electrode structure of FIG. 4*a* and may be driven in the same manner as described with reference to FIGS. 4*b* through 4*d*. Also, sustain discharge signals whose duty rates and timings may be different from one another may be applied to the electrodes of each of the groups.

Figure 5B:
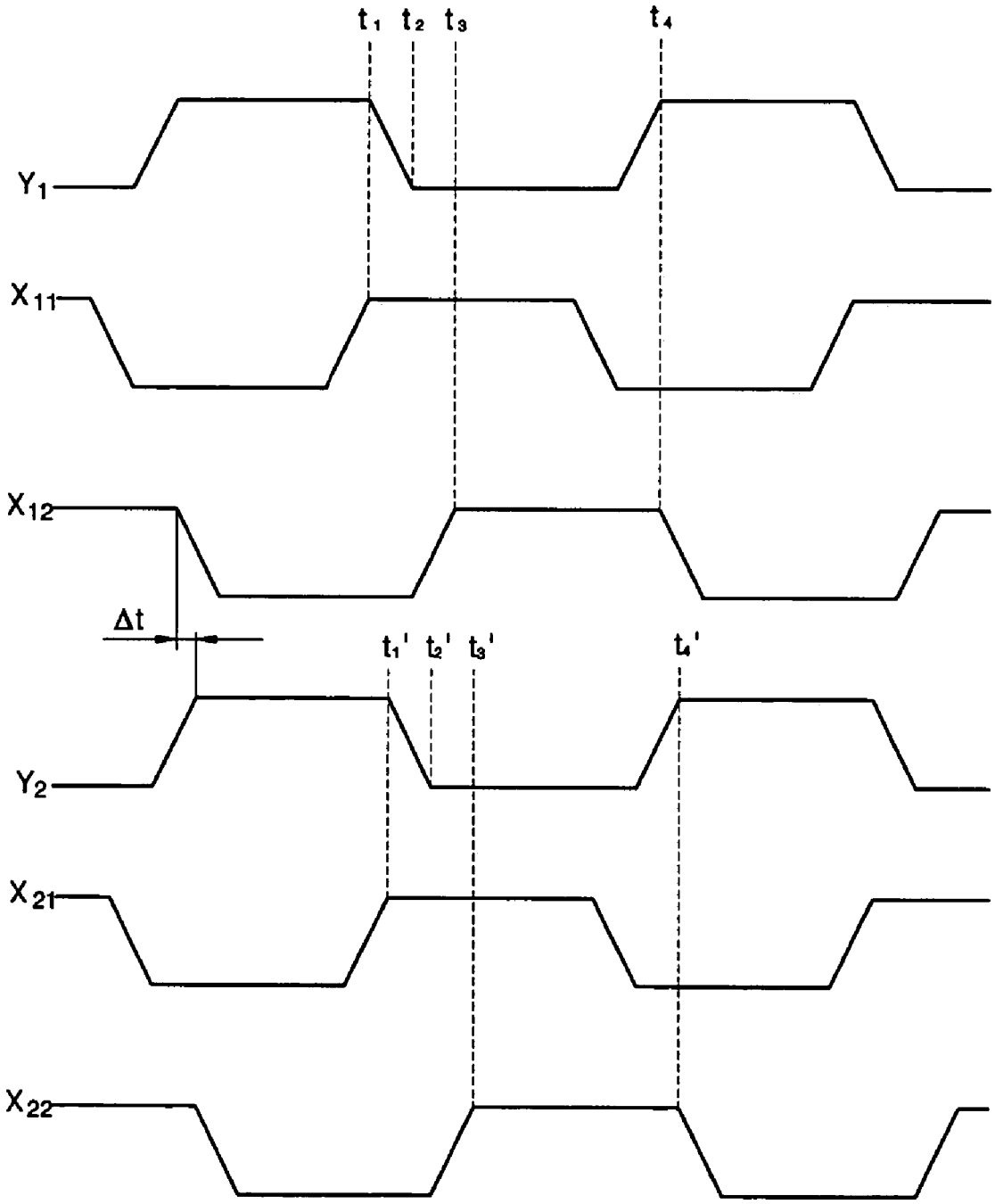
FIG. 5*b* is a timing diagram of a sustain discharge signal applied to the electrode structure of FIG. 5*a*, according to an embodiment of the present invention.

FIG. 5*b* is a timing diagram of a sustain discharge signal applied to the electrode structure shown in FIG. 5*a*, according to an embodiment of the present invention. Pulses with a high level may be applied in a predetermined time interval Δt to each the scanning electrode groups $Y_1$ and $Y_2$. A period for sustain discharge in a group of $Y_1$, $X_{11}$ and $X_{12}$ shown in FIG. 5*b* will be described as follows.

When a sustain pulse with a high level is applied to the scanning electrode group $Y_1$, a level of a common electrode $X_{11}$ of a first group belonging to the scanning electrode group $Y_1$ may change at a time point $t_1$ to a high level. When the common electrode $X_{11}$ of the first group is in the high level, the level of the scanning electrode group $Y_1$ may change at a time point t2 into a low level. When the scanning electrode group $Y_1$ is in the low level, a level of a common electrode $X_{12}$ of a second group may be changed at a time point $t_3$ to a high level. When the common electrode $X_{12}$ of the second group is in the high level, the level of the scanning electrode group $Y_1$ may change at a time point t4 to a high level.

Sustain pulses with a high level may be applied in the predetermined time interval Δt to the scanning electrode groups $Y_1$ and $Y_2$. Accordingly, a second group of $Y_2$, $X_{21}$, and $X_{22}$ also operates in the same manner as in the first group of $Y_1$, $X_{11}$ and $X_{12}$.

Therefore, discharge currents generated in each of the groups may be temporally divided, which allows it to reduce a current peak of a driving circuit. Also, by appropriately adjusting the timings at which the pulses with the high level may be applied to the common electrodes ($X_{11}$, $X_{12}$) and ($X_{21}$, $X_{22}$) in each of the groups, it is possible to control a duty rate of a sustain discharge signal.

Figure 6A:
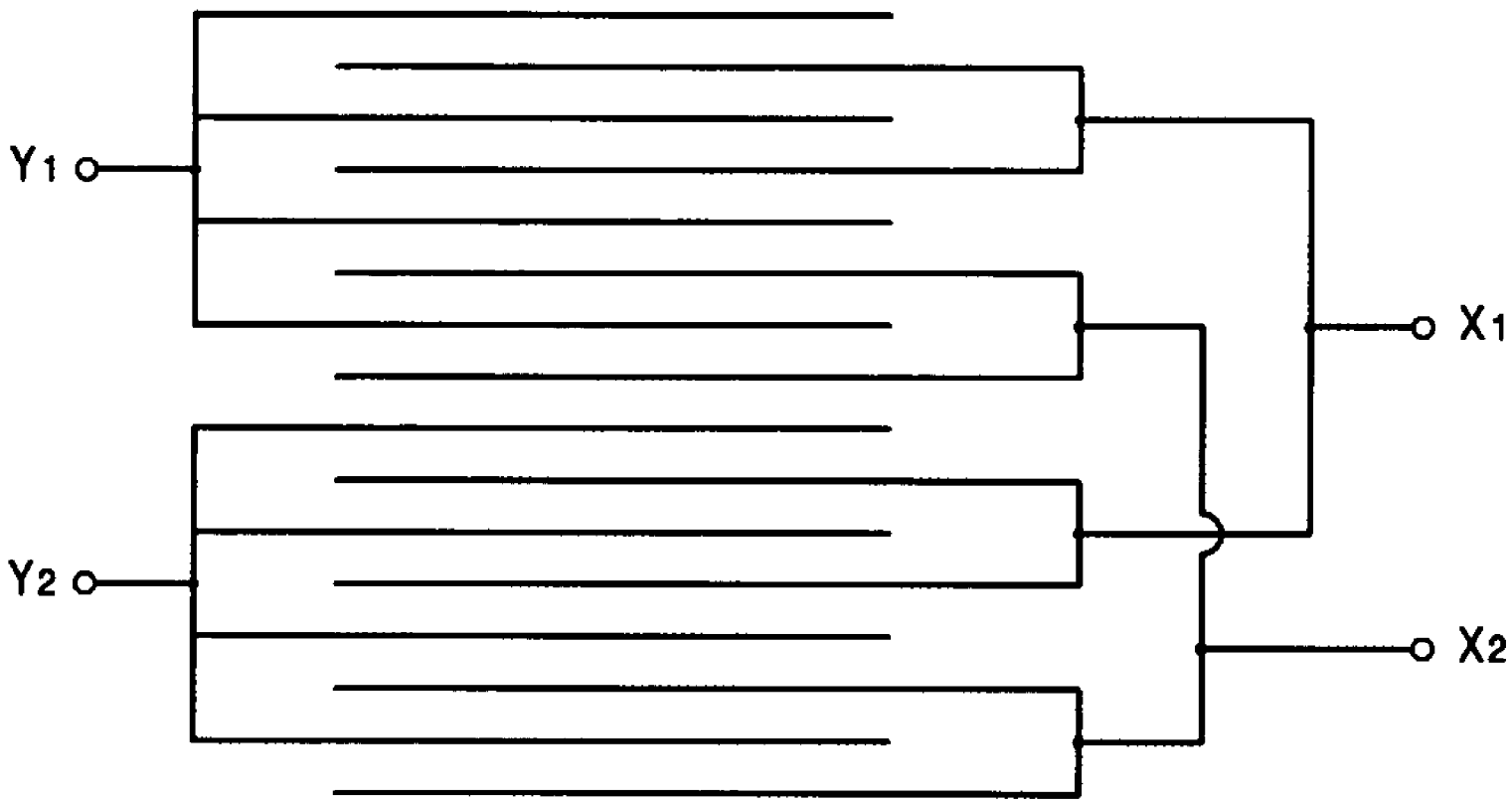
FIGS. 6*a* and 6*b* schematically show electrode structures for sustain discharge of the display panel, according to another embodiment of the present invention.
Figure 6B:
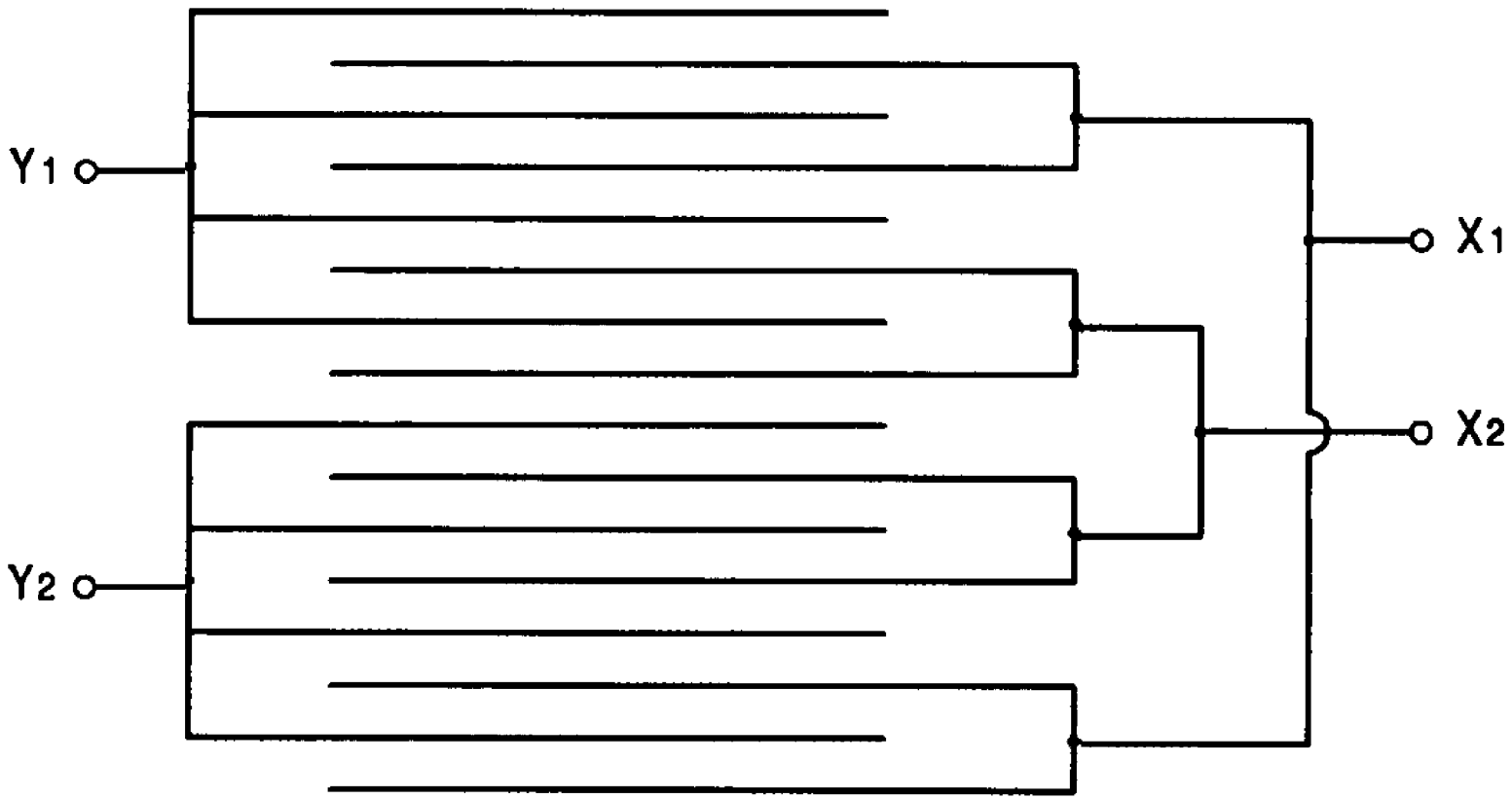
Figure 6C:
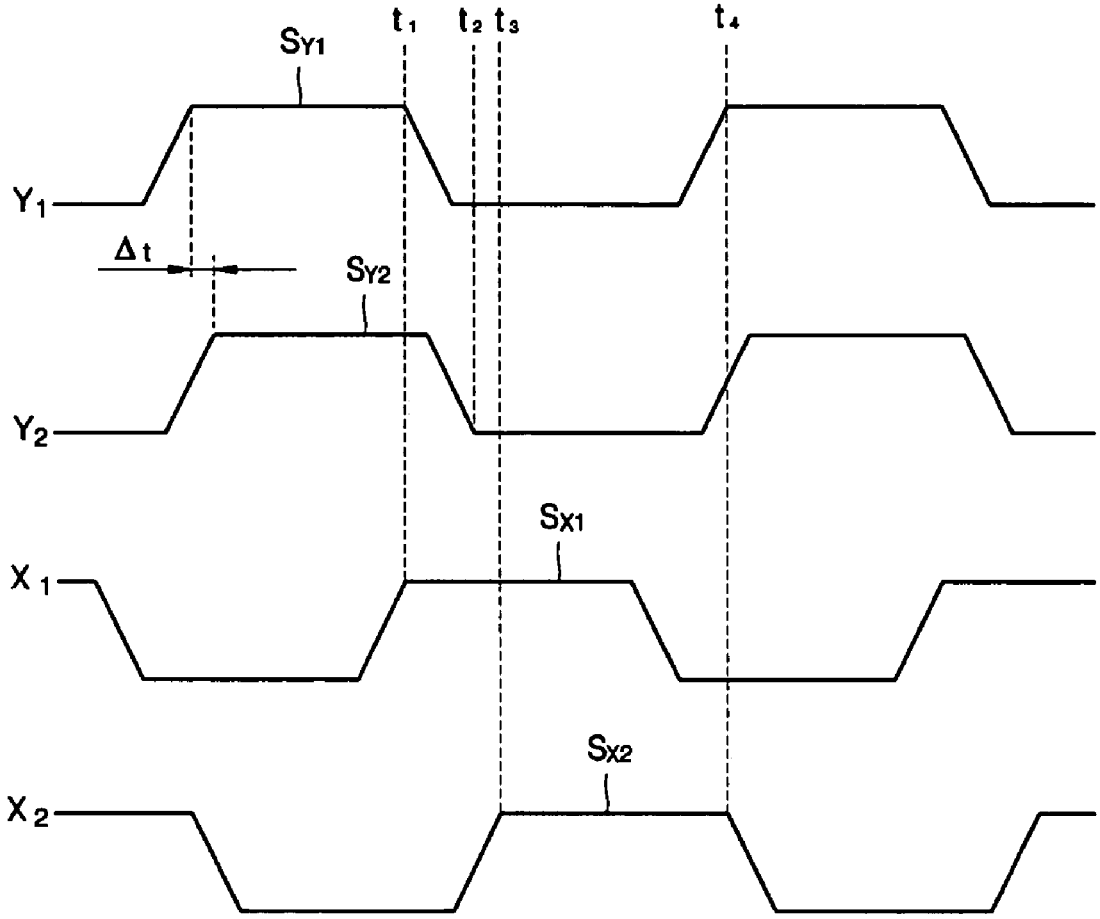
FIG. 6*c* is a timing diagram of a sustain discharge signal applied to the electrode structures of FIGS. 6*a* and 6*b*, according to an embodiment of the present invention.

FIGS. 6*a* and 6*b* schematically show electrode structures for sustain discharge, as modified examples of the electrode structure shown in FIG. 5*a*, according to another embodiments of the present invention. FIG. 6*c* shows a timing diagram of a sustain discharge signal applied to common electrodes $X_1$ and $X_2$ with an intersected structure as shown in FIGS. 6*a* and 6*b*, according to an embodiment of the present invention. Referring to FIG. 6*c*, basically, sustain pulses ($S_{Y1}$, $S_{X1}$, $S_{X2}$) may be applied alternately to scanning electrode group $Y_1$ and common electrodes $X_1$ and $X_2$. Also, sustain pulses ($S_{Y2}$, $S_{X1}$, $S_{X2}$) may be applied alternately to scanning electrode group $Y_2$ and common electrodes $X_1$ and $X_2$. Sustain pulses $S_{Y1}$ and $S_{Y2}$ with a high level may be applied in a predetermined time interval Δt to the scanning electrode groups $Y_1$ and $Y_2$, in an order of $S_{Y1}$->$S_{Y2}$. A period for sustain discharge will be described as follows.

When a pulse of a high level is applied to all the scanning electrode groups $Y_1$ and $Y_2$, a level of a common electrode $X_1$ of a first group may be changed at a time point $t_1$ to a high level. When the common electrode $X_1$ of the first group is in the high level, the levels of the first scanning electrode group $Y_1$ through the final scanning electrode group $Y_2$ may be sequentially changed at a time point $t_2$ to a low level. When the final scanning electrode group $Y_2$ is in the low level, a level of a common electrode $X_2$ of the second group is changed at a time point $t_3$ to a high level. When the common electrode $X_2$ of the second group is in the high level, the level of the first scanning electrode group $Y_1$ may be changed at a time point $t_4$ to a high level. Therefore, discharge currents generated in each of the groups may be temporally divided, which allows it to reduce a current peak of a driving circuit. Sustain pulses with a high level may be applied in an order to $S_{Y1}$->$S_{Y2}$->$S_{X1}$->$S_{X2}$, within a period of a discharge sustain signal, which may be repeated.

Figure 7A:
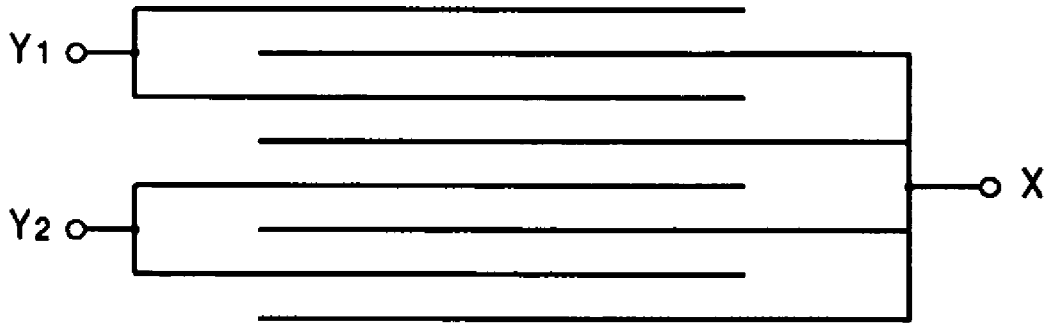
FIG. 7*a* schematically shows an electrode structure for sustain discharge, according to another embodiment of the present invention.

FIG. 7*a* schematically shows an electrode structure for sustain discharge, according to another embodiment of the present invention.

Referring to FIG. 7*a*, during a sustain discharge period, a common electrode X may be driven by a timing signal, and scanning electrodes may be grouped into a first group $Y_1$ and a second group $Y_2$, which may be driven by two different timing signals.

Figure 7B:
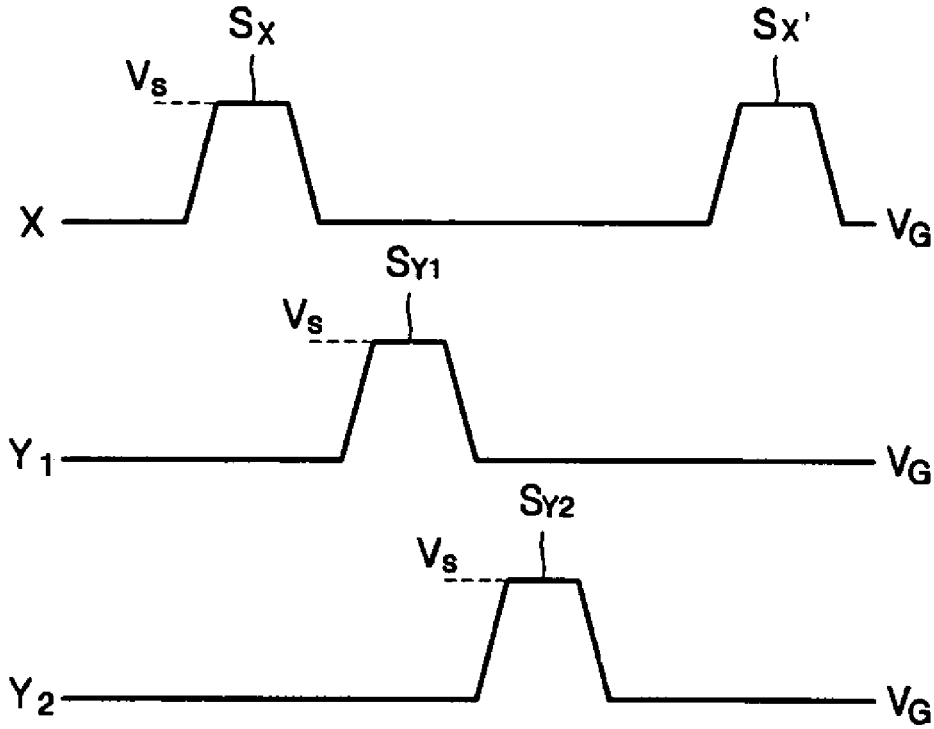
FIGS. 7*b*, 7*c*, and 7*d* are timing diagrams each showing a period of a sustain discharge signal applied to the electrode structure shown in FIG. 7*a*, according to embodiments of the present invention.

FIG. 7*b* is a timing diagram of a period of a sustain discharge signal applied to the electrode structure shown in FIG. 7*a*, according to an embodiment of the present invention. FIG. 7*b* shows a period of a sustain discharge signal applied alternately to a common electrode X and scanning electrodes $Y_1$ and $Y_2$ in a sustain discharge time period. Address electrodes $A_1$ through $A_m$ (not shown) may be maintained in a low level during the sustain discharge period, which will be the same in another embodiments to be described later. Between high level sustain pulses $S_X$ and $S_X'$ applied to the common electrode X, sustain pulses $S_{Y1}$ and $S_{Y2}$ may be applied sequentially to the first scanning electrode group $Y_1$ and the second scanning electrode group $Y_2$. In other words, sustain pulses may be applied sequentially in an order to $S_X$->gap->$S_{Y1}$->gap->$S_{Y2}$->gap->$S_X'$.

Figure 7C:
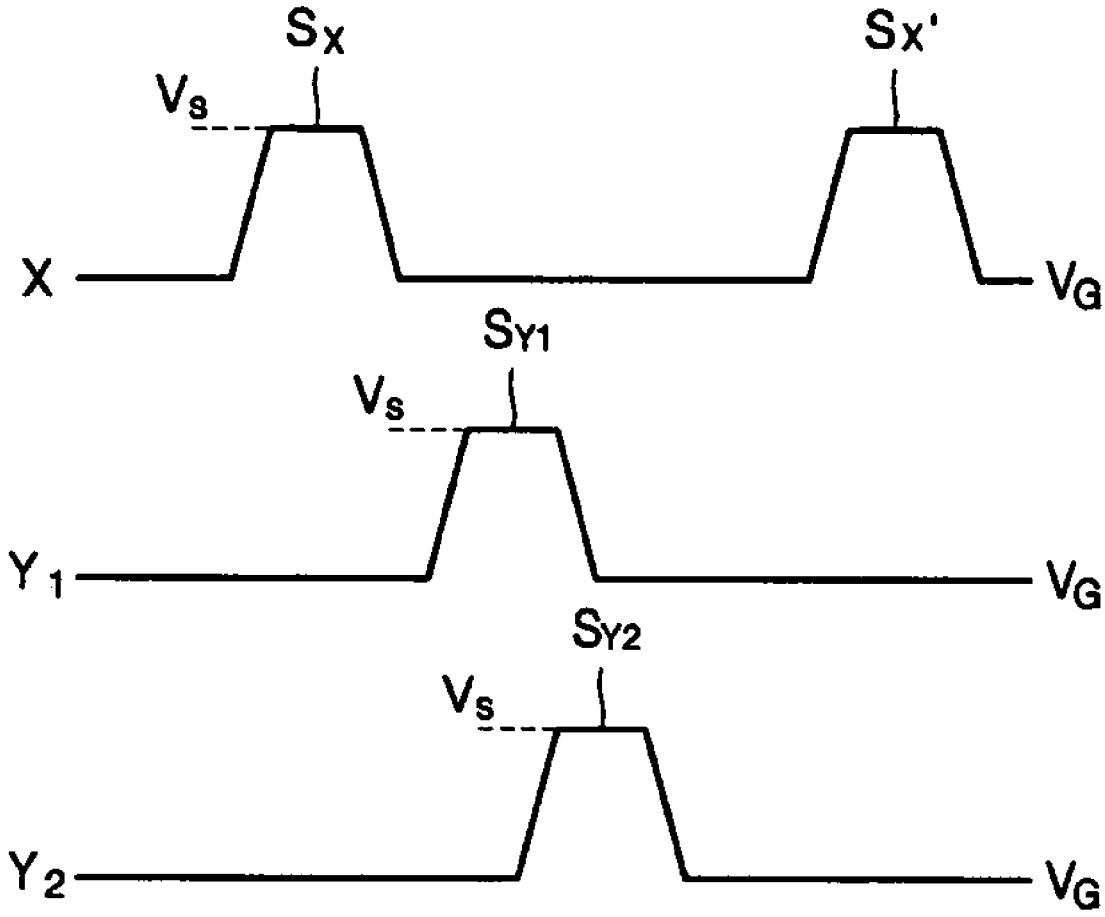

FIG. 7*c* is a timing diagram of a sustain discharge signal applied to the electrode structure shown in FIG. 7*a*, as a modified example of FIG. 7*b*, according to another embodiment of the present invention. Between the high level sustain pulses $S_X$ and $S_X'$ applied to the common electrode X, sustain pulses $S_{Y1}$ and $S_{Y2}$ may be applied sequentially to the first scanning electrode group $Y_1$ and the second scanning electrode group $Y_2$. In other words, the sustain pulses may be applied in an order of $S_X$->gap->$S_{Y1}$->gap->$S_{Y2}$->gap->$S_X'$.

Figure 7D:
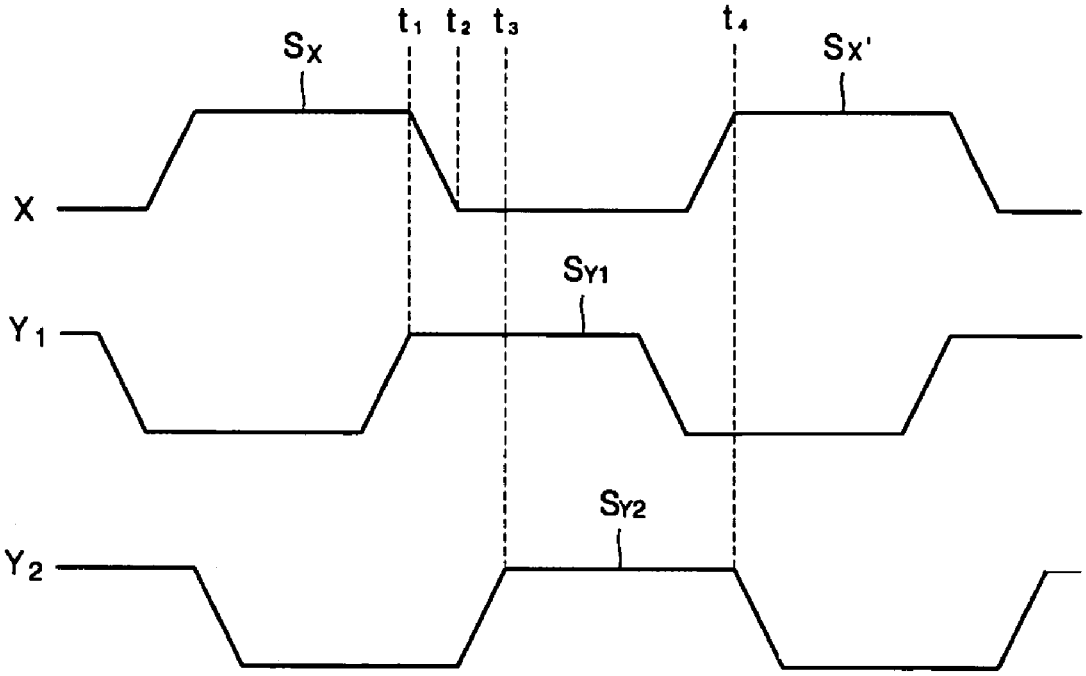

FIG. 7*d* is a timing diagram of a sustain discharge signal applied to the electrode structure shown in FIG. 7*a*, according to another embodiment of the present invention. Between the high level sustain pulses $S_X$ and $S_X'$ applied to the common electrode X, sustain pulses $S_{Y1}$ and $S_{Y2}$ may be applied sequentially to the first scanning electrode group $Y_1$ and the second scanning electrode group $Y_2$. A period for sustain discharge shown in FIG. 7*d* will be described as follows.

When the common electrode X is in a high level, the first scanning electrode group $Y_1$ may be changed at a time point $t_1$ to a high level. When the first scanning electrode group $Y_1$ is in the high level, the level of the common electrode X may be changed at a time point $t_2$ to a low level. When the common electrode X is in the low level, levels of second through final scanning electrode groups $Y_2$ may be sequentially changed at a time point $t_3$ to a high level. When a final scanning electrode group $Y_2$ is in the high level, the level of the common electrode X may be changed at a time point $t_4$ to a high level.

By applying the sustain discharge signal in such a manner, it is possible to maintain a duty rate of a sustain discharge signal near 50% while reducing a current peak, thereby achieving stable sustain discharge.

Figure 8A:
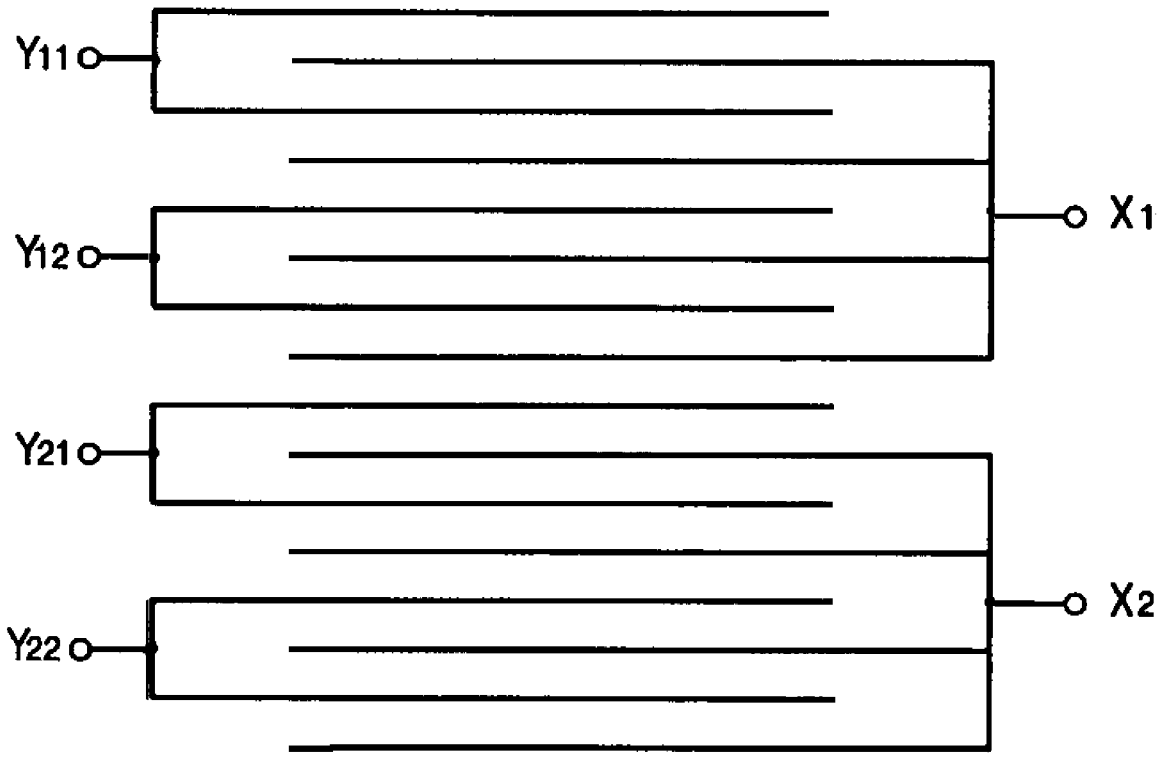
FIG. 8*a* schematically shows an electrode structure for sustain discharge of the display panel, according to another embodiment of the present invention.

FIG. 8*a* schematically shows an electrode structure for sustain discharge, as a modified example of the electrode structure shown in FIG. 7*a*, according to another embodiment of the present invention, Referring to FIG. 8*a*, two common electrode groups $X_1$ and $X_2$ may be driven by two different signals. The respective common electrode groups $X_1$ and $X_2$ may be sub-grouped in pairs with a plurality of scanning electrode groups ($Y_1$, $Y_{12}$) and ($Y_{21}$, $Y_{22}$), respectively. Each of the groups has the same structure as the electrode structure shown in FIG. 7*a* and may be forced to sustain discharge driving in the same manner as described with reference to FIGS. 7*b* through 7*d*. Sustain discharge signals whose duty rates and timings may be different from one another may be applied to each of the scanning electrode groups.

Figure 8B:
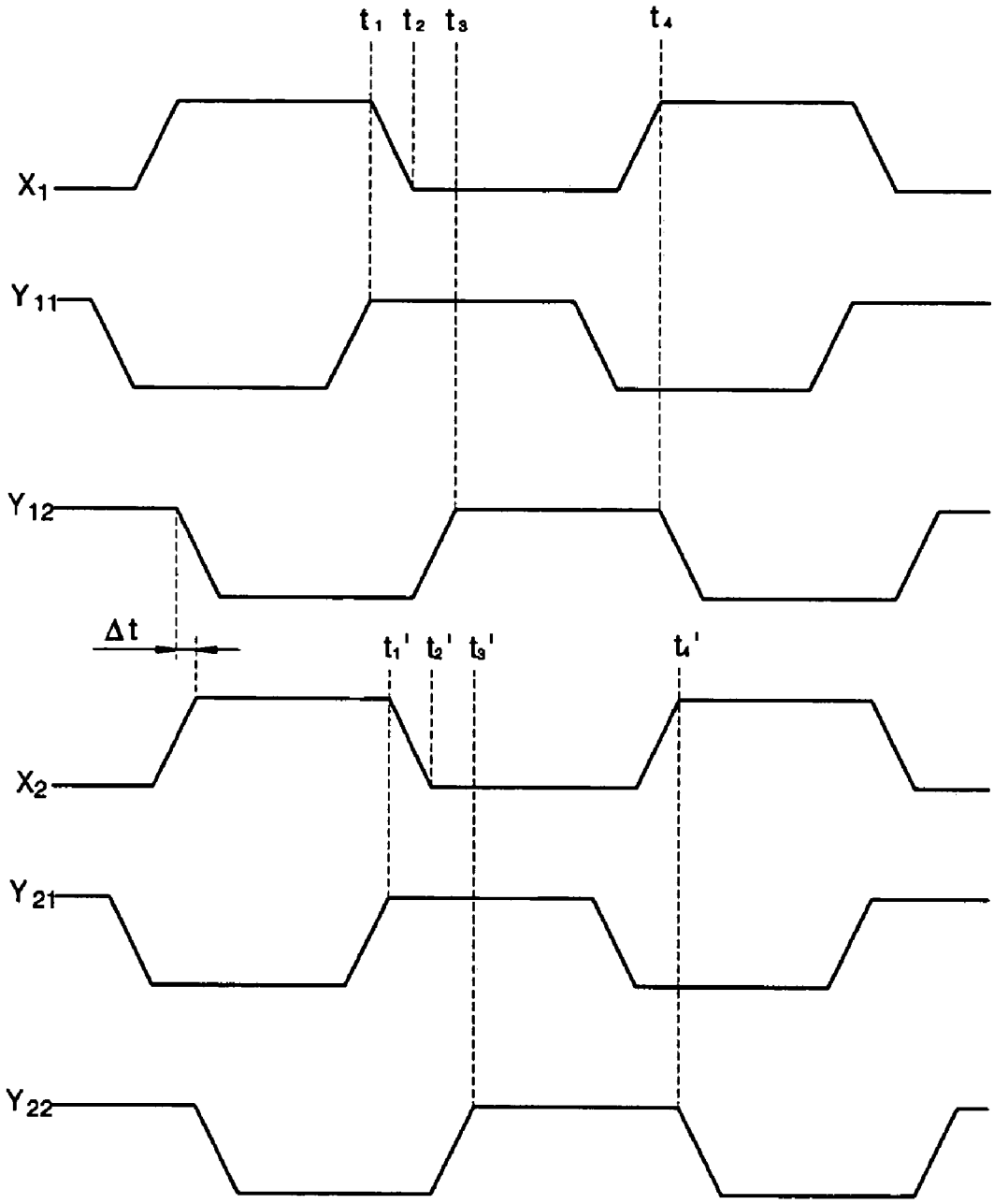
FIG. 8*b* is a timing diagram of a sustain discharge signal applied to the electrode structure of FIG. 8*a*, according to an embodiment of the present invention.

FIG. 8*b* is a timing diagram of a sustain discharge signal applied to the electrode structure shown in FIG. 8*a*, according to an embodiment of the present invention. Pulses with a high level may be applied in a predetermined time interval $\Delta t$ to each of the common electrode groups $X_1$ and $X_2$. In a group of $X_1$, $Y_1$, $Y_{12}$ shown in FIG. 8*b*, a period for sustain discharge will be described as follows.

When a high level pulse is applied to the common electrode group $X_1$, a level of a first scanning electrode group $Y_{11}$ belonging to the common electrode group $X_1$ may be changed at a time point $t_1$ to a high level. When the first scanning electrode group $Y_{11}$ is in the high level, the level of the common electrode group $X_1$ may be changed at a time point $t_2$ to a low level. When the common electrode group $X_1$ is in the low level, a level of a second scanning electrode group $Y_{12}$ may be changed at a time point $t_3$ to a high level. When the second scanning electrode group $Y_{12}$ is in the high level, a level of the common electrode group $X_2$ may be changed at a time point $t_4$ to a high level.

The pulses with the high level may be applied in the predetermined time interval $\Delta t$ to the common electrode groups $X_1$ and $X_2$. Accordingly, a second group of $X_2$, $Y_{21}$, and $Y_{22}$ also operates in the same manner as in the first group of $X_1$, $Y_{11}$ and $Y_{12}$.

Therefore, discharge currents generated in each of the groups may be temporally divided, which allows it to reduce a current peak of a driving circuit. Also, by appropriately adjusting the timings at which the pulses with the high level may be applied to the scanning electrode groups ($Y_{11}$, $Y_{12}$) and ($Y_{21}$, $Y_{22}$) in each of the groups, it is possible to control a duty rate of a sustain discharge signal.

It will be appreciated by one of ordinary skill in the art that the electrode structure and driving signals shown in FIGS. 7*a*, 7*b*, 7*c*, and 7*d* may be reversed in the scanning electrodes and the common electrodes from the electrode structure and driving signals shown in FIGS. 4*a*, 4*b*, 4*c*, and 4*d*. Also, it will be appreciated by one of ordinary skill in the art that the electrode structure and driving signals shown in FIGS. 8*a* and 8*b* may be inverted in the scanning electrodes and the common electrodes from the electrode structure and driving signals shown in FIGS. 5*a* and 5*b*.

Likewise, as not shown in the drawings, the electrode structures shown in FIGS. 6*a* and 6*b* may be changed to reversed structures in the scanning electrode and the common electrode. Also, it is without saying that the timing signals shown in FIG. 6*c* may be applied to the reversed structures in the scanning electrode and the common electrode.

The present invention may be applied to all display devices which have an address period of selecting cells to be turned on in advance and a sustain period of emitting light in the selected cells. For example, by applying sustain pulses alternately to electrodes of forming cells, such as DC type PDPs, EL display devices, or LCDs as well as AC type PDPs, the present invention may be applied to image display devices.

The present invention may be embodied as a program stored on a computer readable medium that may be run on a general computer. Here, the computer readable medium includes but is not limited to storage media such as magnetic storage media (e.g., ROM's, floppy disks, hard disks, etc.), optically readable media (e.g., CD-ROMs, DVDs, etc.), and carrier waves (e.g., transmission over the Internet).

In particular, the panel driving method according to the present invention is made on a computer by a schematic or a VHDL (Very High speed integrated circuit Hardware Description Language). The panel diving method may be implemented by a programmable integrated circuit connected to the computer, for example, FPGA (Field Programmable Gate Array). The recording medium includes such a programmable integrated circuit.

As described above, the display panel and the panel driving method according to the present invention may obtain the following effects.

First, by adopting an electrode structure formed by a predetermined arrangement of one or more scanning electrode groups and one or more common electrode groups, it may be possible to group the common electrodes and scanning electrodes for sustain discharge into a predetermined number of groups and drive each of the groups individually, thereby allowing it to temporally divide discharge currents generated in each of the groups. Accordingly, it may be possible to lower a peak value of currents generated upon sustain discharge driving.

Second, it may be possible to maintain a duty rates of a sustain discharge signal applied sequentially to each of the common electrode groups and each of the scanning electrode groups, near maximum 50%, thereby achieving driving by a stable sustain signal.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method for driving a display panel, the display panel comprising a plurality of scanning electrodes and a plurality of common electrode groups paired with the plurality of scanning electrodes, the method comprising the steps of:

driving a first common electrode group by a first sustain discharge signal having a first sustain discharge pulse;

driving a second common electrode group by a second sustain discharge signal having a second sustain discharge pulse;

driving the plurality of scanning electrodes by a third sustain discharge signal having a third sustain discharge pulse and a fourth sustain discharge pulse, the third sustain discharge pulse and the fourth sustain discharge pulse being consecutive discharge pulses; and after applying the third sustain discharge pulse but before applying the fourth sustain discharge pulse, applying the first sustain discharge pulse to the first common electrode group and applying the second sustain discharge pulse to the second common electrode group.

2. The method of claim 1, wherein a period for sustain discharge comprises:

changing a level of the first sustain discharge signal to a high level when the third sustain discharge signal has a high level;

changing the third sustain discharge signal to a low level when the first sustain discharge signal has the high level;

changing the second sustain discharge signal to a high level when the third sustain discharge signal has the low level; and changing the third sustain discharge signal to a high level when the second sustain discharge signal has the high level.

3. A computer comprising a CPU-useable medium having a CPU-readable program, wherein the CPU-readable program is executed on a CPU of the computer to perform the method of claim 1.

* * * * *

UNITED STATES PATENT AND TRADEMARK OFFICE

CERTIFICATE OF CORRECTION

PATENT NO. : 7,605,779 B2
APPLICATION NO. : 10/958647
DATED : October 20, 2009
INVENTOR(S) : Chung et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1408 days.

Signed and Sealed this

Fifth Day of October, 2010

David J. Kappos

David J. Kappos
*Director of the United States Patent and Trademark Office*